United States Patent [19]

Snell et al.

[11] Patent Number: 4,991,988

[45] Date of Patent: Feb. 12, 1991

[54] COMPONENT WRITING INSTRUMENT HAVING RETRACTABLE CARTRIDGE

[75] Inventors: Thomas G. Snell, Madison; M. David Gandelman, Braneford, both of Conn.

[73] Assignee: BIC Corporation, Milford, Conn.

[21] Appl. No.: 339,776

[22] Filed: Apr. 18, 1989

[51] Int. Cl.[5] ..... A43K 7/12; A43K 24/08

[52] U.S. Cl. ..... 401/111; 401/109; 401/88

[58] Field of Search ..... 401/109, 104, 86, 251, 401/110, 111, 99

[56] References Cited

U.S. PATENT DOCUMENTS

| | | | |
|---|---|---|---|
| 2,400,679 | 5/1946 | Biro | 401/104 |
| 2,443,571 | 6/1948 | Wherry | 401/88 |
| 2,622,561 | 12/1952 | Baker | 401/110 |
| 2,905,147 | 9/1959 | Johmann | 120/42.03 |
| 2,928,374 | 3/1960 | Bergonzo | 120/42.13 |
| 3,051,132 | 8/1962 | Johmann | 120/42.03 |
| 3,064,624 | 11/1962 | Hechtle | 120/42.03 |
| 3,075,497 | 1/1963 | Tate | 120/42.4 |
| 3,079,894 | 3/1963 | Johmann | 120/42.1 |
| 3,084,671 | 4/1963 | Dottlinger | 401/111 |
| 3,092,080 | 6/1963 | Lovejoy | 401/104 |
| 3,137,276 | 6/1964 | Weisser | 401/111 |
| 3,144,005 | 8/1964 | Johmann | 120/42.03 |
| 3,179,088 | 4/1965 | Johmann | 120/42.03 |
| 3,191,329 | 6/1965 | Shea | 40/334 |
| 3,288,115 | 11/1966 | Hechtle | 120/42.03 |
| 3,382,577 | 5/1968 | Rieder | 401/88 X |
| 3,510,977 | 5/1970 | Hechtle | 40/334 |
| 4,755,075 | 7/1988 | Leem | 401/86 |
| 4,790,678 | 12/1988 | Araki | 401/109 |
| 4,932,800 | 6/1990 | Lin | 401/88 |

FOREIGN PATENT DOCUMENTS

| | | |
|---|---|---|
| 253464 | 7/1964 | Australia . |
| 906095 | 4/1987 | Belgium . |
| 1438554 | 4/1965 | France . |

*Primary Examiner*—Richard J. Johnson

*Attorney, Agent, or Firm*—Pennie & Edmonds

[57] ABSTRACT

A writing instrument such as a pen having an elongated housing of an extruded plastic tube, a molded tip member which is press fit into one end of the housing, a cartridge containing a writing medium therein such as ink therein, and including a writing tip for contacting a substrate such as paper, a molded combined clip/cam member press fit into the opposite end of the housing for retaining the cartridge therein, and an extension and retraction system for positioning the cartridge in either a first position where the tip extends beyond the forward end of the tip member or in a second position where the cartridge and tip are retained within the tip member and housing. The clip/cam member preferably includes a clip for attachment to clothing or the like while the housing preferably includes a matte finish thereon. This soft finish may be achieved by sand blasting the housing or by including an outer covering of a soft feel material such as a soft plastic or elastomer. When the outer covering is included, decorative score lines may be provided therein, either circumferentially or longitudinally.

34 Claims, 5 Drawing Sheets

COMPONENT WRITING INSTRUMENT HAVING RETRACTABLE CARTRIDGE

TECHNICAL FIELD

The invention relates to a writing instrument, preferably in the form of a pen, which is made by assembling a molded tip member and clip/cam member on opposite ends of an extruded tube, after a writing medium, such as a cartridge, is placed therein. The molded components include means for extending and retracting the cartridge, thus providing a disposable pen of low cost construction.

BACKGROUND ART

Disposable ballpoint pens are well known in the art. One common version, known as a "stick pen", includes a combined tip/ink supply which is press fit into one end of a housing. Such pens generally include a cap member to cover and protect the writing tip during periods of non-use. When the pen is to be used, the cap is removed and placed on the opposite end of the housing. It is also typical for such cap members to include an integral clip for attachment to the pocket of the user during periods of non-use. The storage of the pen in an "upside down" position sometimes results in leakage of ink into the pocket of the user, while the cap members are often lost or discarded.

Retractable pens are also known in the art. These pens usually include two molded body components—a replaceable ink cartridge, and an internal extension/retraction mechanism. The body components are generally joined by mating threads to provide easy access to the interior of the pen, primarily for replacement of the cartridge after the ink is depleted. Such pens are generally more expensive than the stick pens, and can be continuously used by merely replacing the ink cartridge. One example is disclosed in U.S. Pat. No. 3,288,115 to Hechtle.

At present, however, an inexpensive disposable stick pen which includes a mechanism for extending and retracting the writing cartridge to facilitate use and storage while avoiding unwanted transfer of ink from the writing point, as by transfer to a garment pocket, for example, does not exist. We have invented such a writing instrument.

SUMMARY OF THE INVENTION

The present invention relates to a writing instrument which includes an elongated housing having a generally uniform cross section and defining a central opening along its length; tip means attachable to the housing at a first end portion and defining an opening communicable with the central opening of the housing; writing means positionable within at least a portion of the central opening of the housing and extending through the tip portion for writing on a substrate; cam means attachable to the end of the housing opposite the first end portion at least for retaining the writing means therein; and means for positioning the writing means in either a first position whereby the writing means extends through the tip member and is capable of contacting a substrate for writing thereupon, or a second position whereby the writing means is maintained within the tip member and housing.

The tip and cam means are each provided with an extension member dimensioned and configured for insertion into the central opening of the housing in interference relation therewith for retention of the tip means and cam means in engagement therewith. The housing is generally cylindrical and is cut from an extruded tube. Each extension of the tip means and cam means is an elongated tube which has an outer diameter of approximately the same dimension as the inner diameter of the housing, preferably including a circumferential rib member on an outer surface for locking engagement with the inner diameter of the housing. Preferably, the cam means is provided as a combination clip/cam member.

The writing means preferably comprises a cartridge having a writing tip and a supply of writing medium therein. This cartridge is movable to the first position wherein the cartridge tip extends beyond the forward end of the tip member for writing upon the substrate, and to the second position wherein the cartridge tip is retracted within the tip member for storage during periods of non-use. The extending and retracting of the cartridge is accomplished by a mechanism which includes a plunger terminating in a set of teeth; a ratchet member dimensioned for positioning within the clip/cam member and having a set of teeth on its outer surface; and a plurality of slots on the inner surface of the clip/cam member. These slots are dimensioned and configured to cause alternative engagement and turning of the plunger teeth to permit entry of the ratchet teeth into the slots, and to retain the ratchet in a retract position. The ratchet is further provided with an inwardly positioned set of auxiliary teeth for contact with the plunger teeth when the plunger engages the ratchet. The ratchet also includes an elongated extension which is received within the plunger to facilitate high speed assembly of the plunger and ratchet.

The writing medium is generally an ink and the plunger includes means for indicating the color of the ink. Generally, such ink color indicating means comprises an end portion of said plunger and a sleeve member positioned therearound. Also, the writing instrument further comprises a spring operatively associated with the cartridge and the extending and retracting means to facilitate the extension and retraction of the cartridge.

It is also possible to provide a refillable writing instrument by providing a combined clip/cam member and the opposite end of the housing tube with threads for locking engagement therebetween. Thus, the cartridge can be replaced after the writing medium is depleted. For low cost construction, the housing may be cut from an extruded plastic tubular member, and the clip/cam member may also include a clip member to facilitate selective attachment to clothing or the like. In this embodiment, the cartridge includes a pair of outwardly extending members for retaining one end of the spring in position relative to the cartridge, and the tip member includes a shoulder therein dimensioned and configured for retaining the opposite end of the spring.

Another embodiment of the writing instrument of the invention relates to a soft feel housing. For example, the outer surface of the housing can be sandblasted to provide a matte finish thereon. Instead, the housing can include an outer covering of a soft feel material, such as a plastic or elastomeric material either co-extruded with the housing or otherwise applied as by layering, coating, etc.

The outer covering may also include at least one decorative score line therein, either extending circumferentially around or longitudinally along the covering. The score line may extend through the outer covering to reveal a color different from that of the outer covering. If desired, a plurality of score lines can be provided in a predetermined pattern. This can be easily accomplished when the outer covering is co-extruded with the housing by cutting or slitting the outer covering.

BRIEF DESCRIPTION OF THE DRAWINGS

Further benefits and advantages of the invention will become apparent from a consideration of the following description given with reference to the accompanying drawing figures which specify and show preferred embodiments of the invention, wherein.

DETAILED DESCRIPTION OF THE PREFERRED EMBODIMENTS

Figure 1:
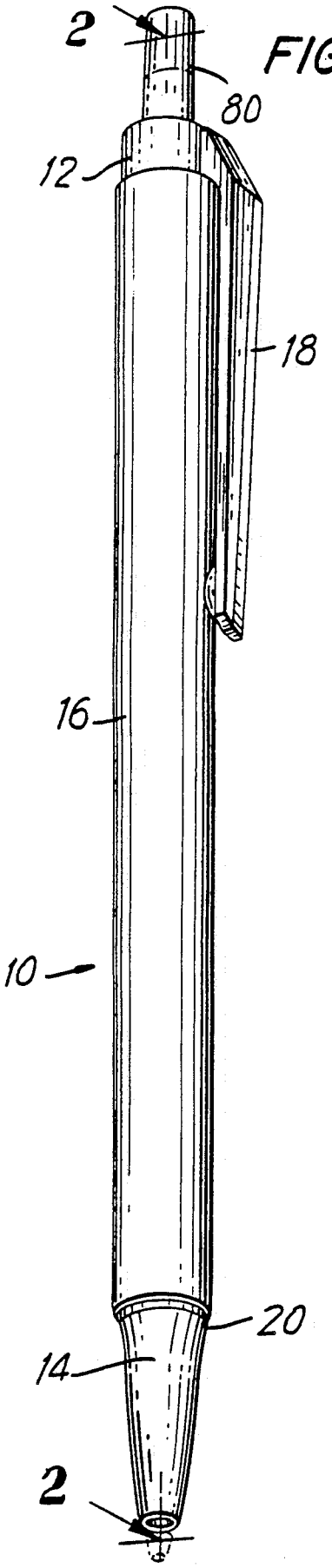
FIG. 1 is a perspective view of a writing instrument in accordance with the present invention.
Figure 4:
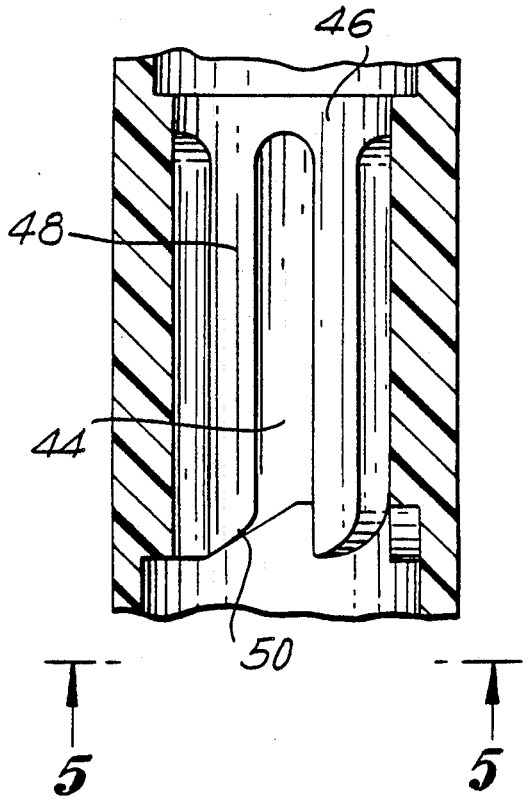
FIG. 4 is a cross-sectional view of a portion of the clip/cam member of the writing instrument of FIG. 3, taken along lines 4—4 thereof.
Figure 5:
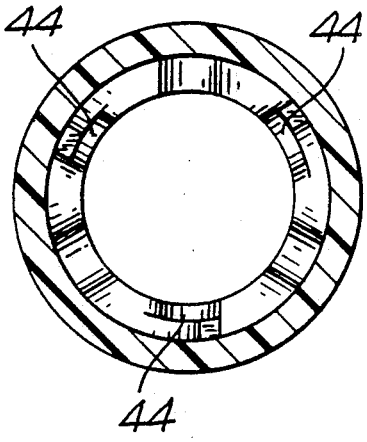
FIG. 5 is a cross-sectional view of the clip/cam member of FIG. 4 taken along lines 5—5 thereof.
Figure 3:
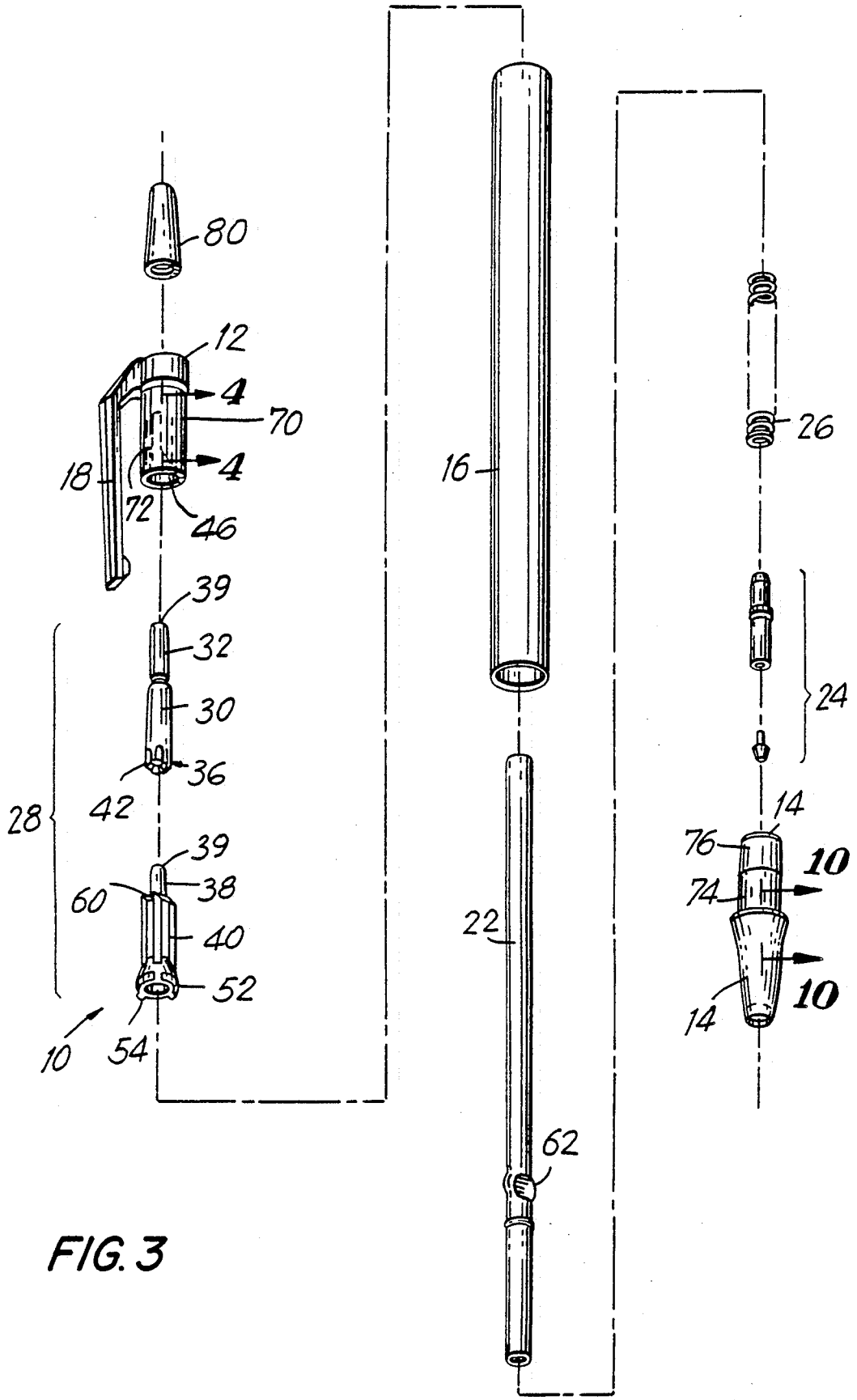
FIG. 3 is an exploded view of the writing instrument of FIG. 1 to detail the various components used in assembly.
Figure 6:
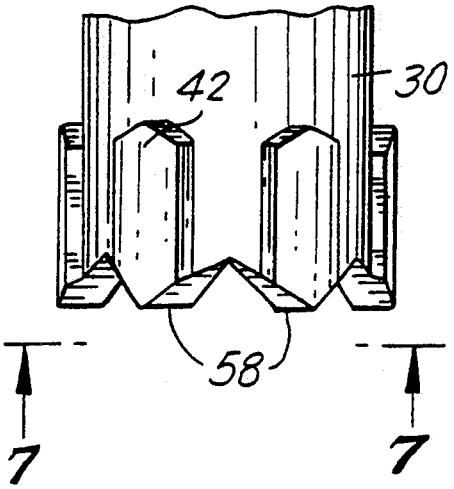
FIG. 6 is an expanded partial view of the plunger mechanism of FIG. 3 to illustrate the ratchet teeth thereupon.
Figure 8:
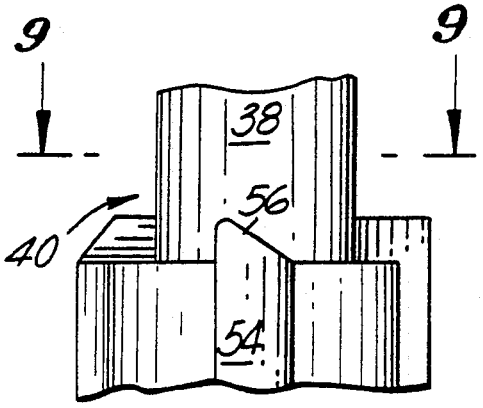
FIG. 8 is an exploded partial view of the ratchet mechanism of FIG. 3.
Figure 9:
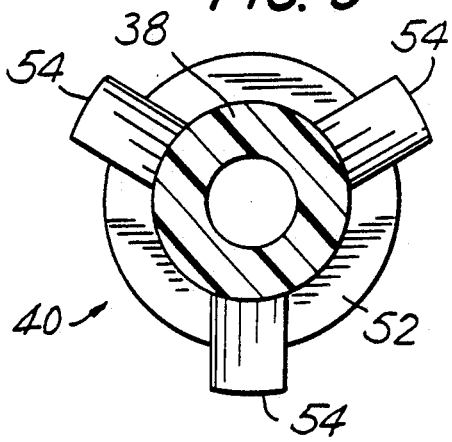
FIG. 9 is a top view, partially in cross-section, of the ratchet mechanism of FIG. 8 taken along lines 9—9 thereof.
Figure 7:
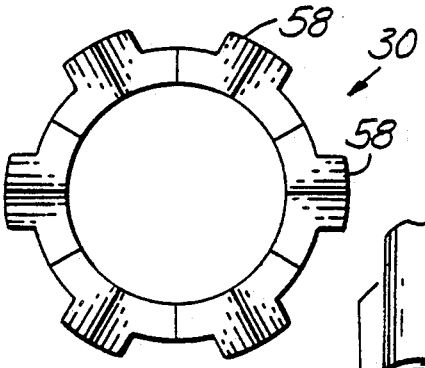
FIG. 7 is a bottom view of the plunger mechanism of FIG. 6 taken along lines 7—7 thereof.

Referring initially to FIGS. 1 and 3, there is illustrated a writing instrument 10 preferably in the form of a pen which includes a combination clip 18/cam 12, tip member 14 and an elongated extruded housing 16. The clip/cam member includes a clip 18 to facilitate storage during non-use by attachment of the pen to clothing or the like with the writing tip facing downward and the cartridge facing upward. The tip member 14 includes a tapered portion 20 to facilitate handling by the user.

Figure 2:
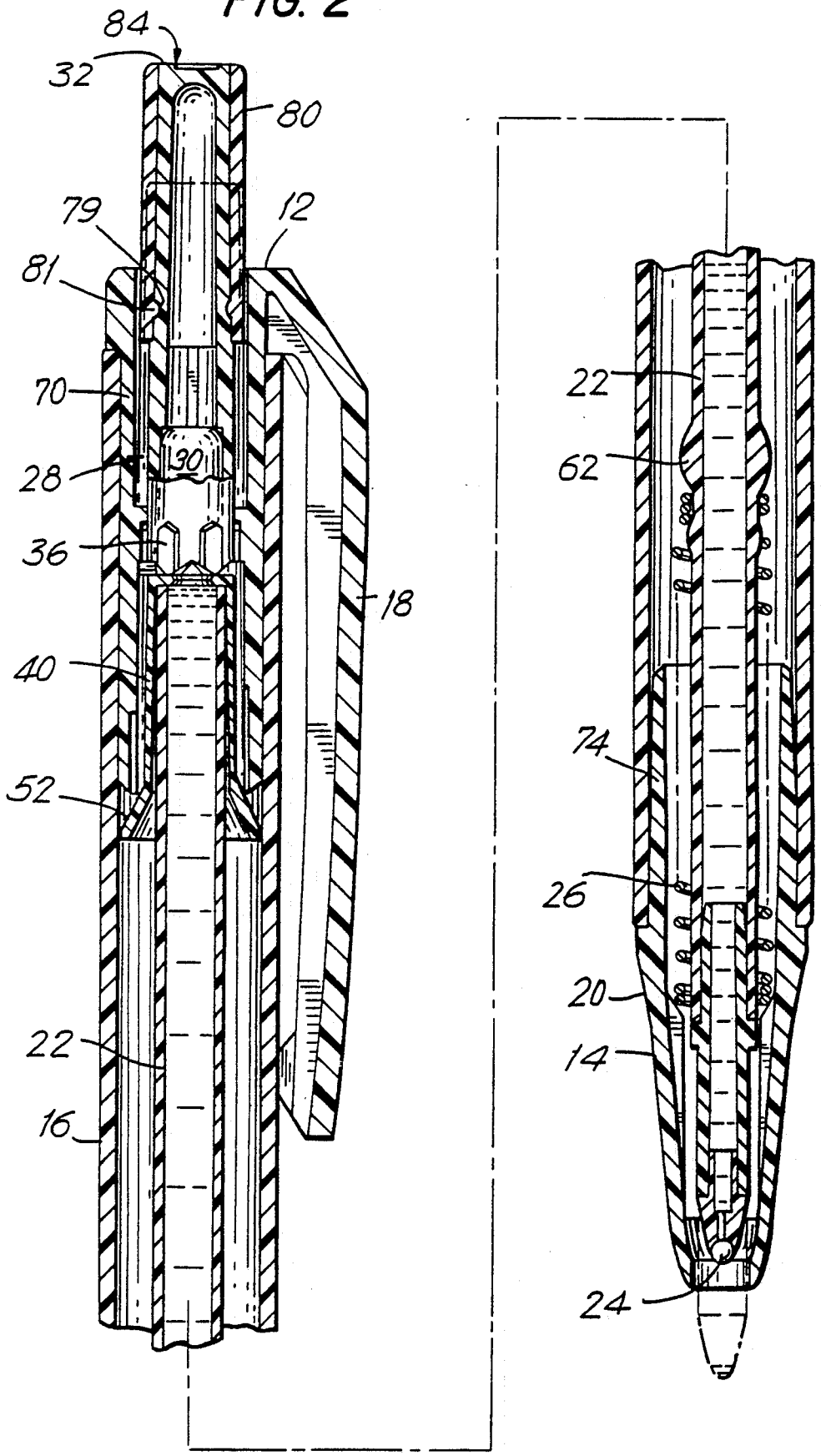
FIG. 2 is a cross-sectional view of the writing instrument of FIG. 1 taken along lines 2—2 thereof.

Referring to FIG. 2, pen 10 includes a cartridge 22 which contains a supply of ink therein and a writing tip 24 for engaging substrates such as paper and the like for writing purposes. Although this pen is configured generally in the form of a stick pen, the clip/cam and tip members include various components which are operatively associated with the cartridge 22 and spring 26 to facilitate extension of the cartridge tip to a first position shown in phantom in FIG. 1 wherein the tip extends from the tip member 14 and to a second position wherein the cartridge is fully retained within the pen for periods of storage or non-use. These components form an extension and retraction mechanism 28 which generally includes a plunger 30 which terminates in an exposed push-extension 32 for projecting through the top opening of clip/cam 12. The opposite end of plunger 30 includes a hub 36 which has a central opening to receive the stem portion 38 of ratchet 40. Plunger 30 is preferably formed with six laterally extending guides 42 adapted to slide in slots 44 formed on the inner wall 46 of cam member 12. These slots are positioned between rails 48 terminating in tapered teeth 50. Guides 42 of plunger 30 are always positioned in slots 44 thus providing a longitudinal non-rotational movement of the plunger in the cam member 12. Ratchet 40 is provided with a hub 52 from which three laterally extended guides 54 each provided with a tapered tooth 56 on an upper face thereof to engage tapered teeth 50 of rails 48 on the inner surface of the clip/cam member 12. The lower end of plunger 30 terminates in six teeth 58 which also engage the tapered teeth 56 on the three guides 54 of ratchet 40. Thus, when ratchet 40 is inserted into the bore of plunger 30, tapered teeth 58 of the plunger and tapered teeth 60 of the ratchet will engage each other and align the parts, thus preventing the sharp edges of the tapered teeth 56 from cutting into the plunger and jamming the mechanism while also preventing rotation of the ratchet.

The design of the teeth of the plunger 30, the ratchet 40 and the clip/cam member cause the ratchet to rotate slightly when released from the clip/cam and again when the ratchet teeth engage the clip/cam member. The ratchet teeth alternately move from a first position on teeth 50 into a second position where the ratchet teeth 50 of clip/cam member 12 and slide into slots 44. From either position the plunger, when pressed, will free the ratchet from the clip/cam member, allowing the ratchet to rotate slightly until the teeth lock. Then, when deposited once more on the clip/cam member, the teeth may rotate slightly again until caught in the first position or second position, depending upon the position of the ratchet guides with respect to the clip/cam member slots.

The ratchet rotates slightly when depressed by the plunger 30 and again on the clip/cam teeth when the plunger 30 is withdrawn, causing a circular movement that permits the cartridge to be alternately extended or retracted.

Spring 26 operates on spring stops 62 of the cartridge to force the cartridge continuously against the ratchet in the bore. A bevelled seat is provided in the hub 52 of the ratchet to facilitate insertion of the end of the cartridge therein. The top portion 38 of the ratchet 40 has a rounded configuration shown at 39 assists in maintaining alignment throughout the extension and retraction operation. A more important function of the top portion 38 of ratchet 40 is that it is configured and dimensioned of a sufficient length to facilitate the high speed assembly of the plunger 30 upon ratchet 40. Also, top portion 38 is radiused at its free end 39 thus permitting it to be quickly inserted into the aperture of plunger 30, i.e. the top portion 38 is "self-locating" for high speed assembly purposes. This configuration is critical to achieve a desirable assembly rate for high speed production.

Clip/cam member 12/18 includes an elongated extension member 70 with raised surface portion 72 for insertion into the top end of housing 16 in interference fit.

Figure 10:
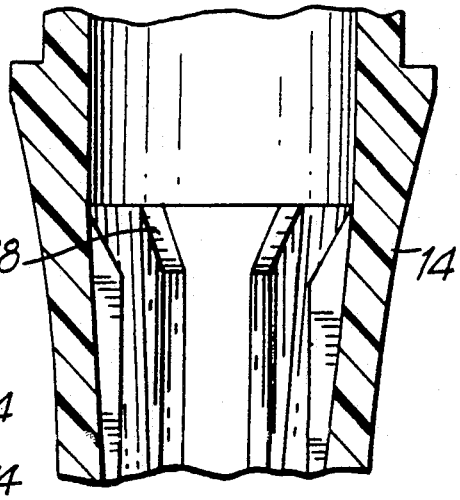
FIG. 10 is a partial cross-sectional view of the tip member of FIG. 3 taken along lines 10—10 thereof.

This extension and the raised surface enables the member to be securely engaged to the housing so that forces such as those generated by operating the extension and retraction mechanism will not cause the clip/cam member to be disengaged from the housing. Similarly, tip member 14 includes extension 74 and tempered end 76 for quick engagement with the lower end of tubular housing 16. FIG. 2 illustrates in cross section, the position of the components when the pen is fully assembled. Tip member 14 also includes baffles 78 (best seen in FIG. 10) for securely retaining the bottom of spring 26 to assist in the extension and retraction capability of the pen. Of course, these baffles provide sufficient interior space for the cartridge tip and cartridge to extend therethrough so that the tip member may be quickly moved into a writing position wherein it extends beyond the end of the tip member 14.

Figure 11:
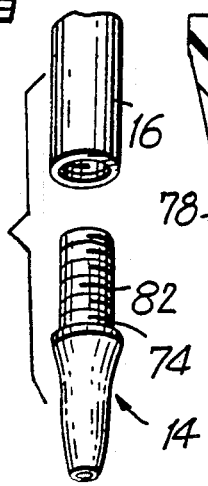
FIG. 11 is a view of an alternate construction for the tip member and lower housing of another writing instrument in accordance with the invention.

As such, the writing instrument of the invention can be manufactured from relatively low cost components so that it can be considered to be disposable. However, in another embodiment, as best illustrated in FIG. 11 a slight modification can render the pen of the type where the cartridge 22 is replaceable. This modification consists of forming threads 82 on the extension 74 of tip member 14 while providing corresponding threads on the lower end of tubular housing 16. Thus, when the ink cartridge 22 is depleted, the user can remove tip member 14 by unscrewing it from body member 16, thus enabling the user to obtain access to the interior portion of the pen for replacement of cartridge 22.

Another embodiment of the invention relates to a novel indicator for the color of ink utilized in the pen. This indicator includes a cover member 80 which is placed over and snap fitted around the top portion 32 of plunger 30 by circumferential groove 79 and snap-fitting ridge 81. Cover member 80 can be provided in a color to match that of the ink in cartridge 22, or it can be provided as a contrasting color to that of the other pen components, for example black, white, silver, etc. When cover 80 is provided in contrasting color, the top portion 84 may be open as shown so that the top surface of the plunger mechanism 32 or the plunger mechanism itself, may be provided with the same color as the cartridge ink. This provides an indicator of the color of the ink. If desired, the entire molded clip/cam member and/or tip member may be provided in a color to match that of the cartridge ink.

Figure 12:
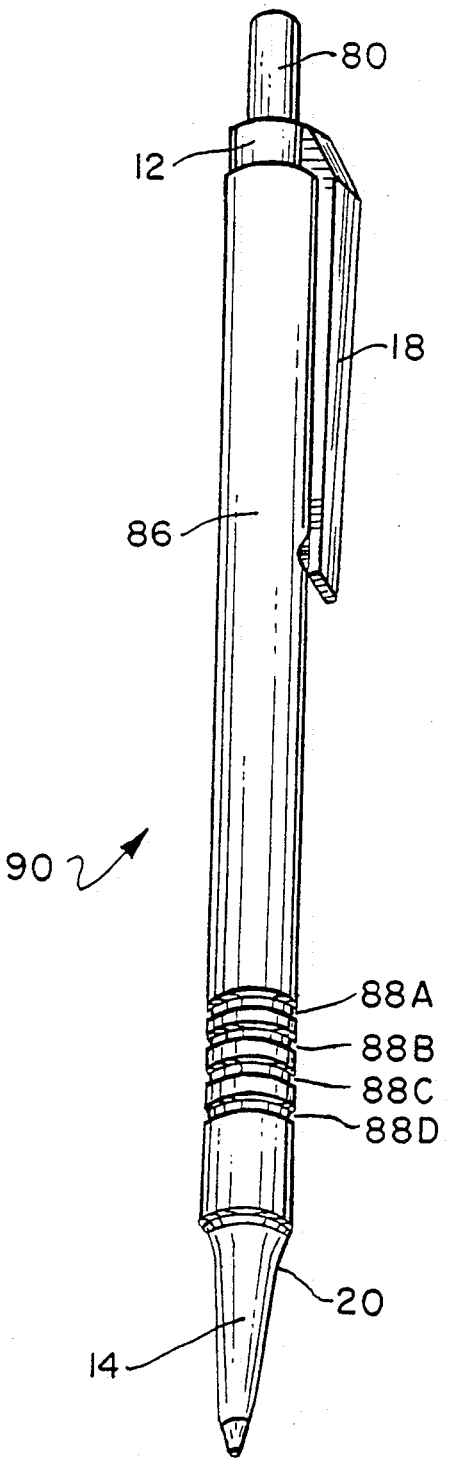
FIG. 12 is a perspective view of a writing instrument in accordance with the present invention showing an elastomer covering having a plurality of score lines.

Another feature of the invention relates to the provision of a soft finish on the housing 16 as shown in FIG. 12 as extruded elastomer covering 86. In this FIG., components of the pen 90 which are identical to those of FIG. 1 include the same numerals. Such a finish enables the user to write for longer periods of time with less a discomfort due to the soft feel feature of the housing. This soft finish feature can be incorporated into the housing by sand blasting the housing to the desired degree. Alternatively, as noted previously, a soft material 86 such as plastic or an elastomer can be either placed around the housing 16 as by layering or coating, etc. Preferably it is co-extruded with the housing to form a tight bond thereto. A wide variety of plastic materials such as PVC, polyethylene, etc. or elastomers which are generally known to those skilled in the art can be used as the outer covering.

Figure 13:
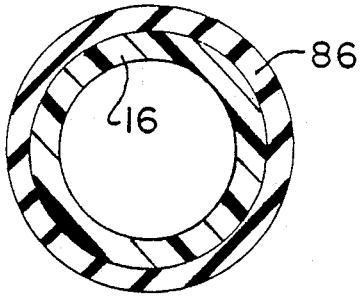
FIG. 13 is a cross-sectional view of the writing instrument in FIG. 12 showing the outer elastomer layer and inner plastic layer.

The co-extrusion operation as noted above enables this soft feel covering to be securely attached and bonded to the thermoplastic tube which serves as the housing. The relationship of the soft feel covering 86 to the housing 16 is shown in FIG. 13. In this embodiment, the housing covering may be provided with one or more score lines which extend either partially into the covering or all the way through to the housing tube. Such score lines can extend either longitudinally or circumferentially, as shown FIG. 12, where score lines 88A, 88B, 88C and 88D extend through covering 86 to expose housing 16. Optionally, a plurality of such score lines may be included. Combinations of longitudinal or circumferential score lines can also be used if desired. Spiral score line(s) can also be used. These score lines 88A, 88B, 88C and 88D can enable the user to grip on the housing more securely. Moreover, the soft covering 86 as noted above enables the user to experience less discomfort to the hand during extended writing operations.

When the score line(s) extends completely through the covering into the tubular housing, it is possible to manufacture the housing of a different color from that of the covering. In this regard, it is also possible to use the color of the housing, as is evident by viewing it through the score lines, as an indication of the color of the ink in the cartridge. This feature can be used in conjunction with or alternately to the color indicating means noted above.

While it is apparent that the invention herein disclosed is well calculated to fulfill the objects above stated, it will be appreciated that numerous modifications and embodiments may be devised by those skilled in the art and it is intended that the appended claims cover all such modifications and embodiments as fall within the true spirit and scope of the present invention.

What is claimed is:

1. A writing instrument comprising:

an elongated housing having a generally cylindrical shape, said housing being cut from an extruded tube having a generally uniform cross-section as an outer surface and defining a central opening along its length;

tip means attachable to said housing at a first end portion and defining an opening communicable with said central opening of said housing;

writing means positionable within at least a portion of said central opening of said housing and said tip means for writing on a substrate;

cam means attachable to the end of said housing opposite said first end portion at least for retaining said writing means therein;

means for positioning said writing means in one of a first position whereby said writing means extends through said tip means and is capable of contacting a substrate for writing thereupon, or a second position whereby said writing means is maintained within said tip means and housing;

said tip means and cam means each including an extension member dimensioned and configured for insertion into said central opening of said housing in interference relation therewith for retention of said tip means and cam means in engagement therewith; and means located upon said housing outer surface for providing a predetermined finish thereto which facilitates non-slip contact and comfort during use of the writing instrument.

2. The writing instrument of claim 1 wherein each extension of said tip and cam means is an elongated tube which has an outer diameter of approximately the same dimension as the inner diameter of said elongated housing.

3. The writing instrument of claim 2 wherein each elongated tube of said tip and cam means includes a circumferential rib member on an outer surface for locking engagement with said inner diameter of said housing tube.

4. The writing instrument of claim 1 wherein the writing means comprises a cartridge having a writing tip and supply of writing medium therein.

5. The writing instrument of claim 4 wherein said cartridge is movable to said first position wherein said cartridge tip extends beyond the forward end of said tip means for writing upon the substrate, and to said second position wherein said cartridge tip is retracted within said tip means for storage during periods of non-use.

6. The writing instrument of claim 1 wherein said housing is an extruded plastic tubular member; and wherein said clip/cam means further comprises a clip member to facilitate selective attachment to clothing or the like.

7. The writing instrument of claim 1 wherein said housing outer surface finish providing means comprises a sandblasted matte finish.

8. The writing instrument of claim 1 wherein said housing outer surface finish providing means comprises an outer covering of a soft feel material.

9. The writing instrument of claim 8 wherein said outer covering comprises a plastic or elastomeric material having a durometer which provides cushioned comfort to the user and further provides non-slip contact with the users' hand.

10. The writing instrument of claim 8 wherein said outer covering includes at least one decorative score line therein.

11. The writing instrument of claim 10 wherein said score line extends circumferentially around said covering.

12. The writing instrument of claim 10 wherein said score line extends longitudinally along said covering.

13. The writing instrument of claim 10 wherein said score line extends through said outer covering to reveal a color different from that of said outer covering.

14. The writing instrument of claim 13 wherein a plurality of said score lines are provided in a predetermined pattern.

15. The writing instrument of claim 8 wherein said outer covering is co-extruded around said housing.

16. A writing instrument comprising:

an elongated housing having a generally uniform cross section and defining a central opening along its length;

tip means attachable to said housing at a first end portion and defining an opening communicable with said central opening of said housing;

writing means positionable within at least a portion of said central opening of said housing and said tip means for writing on a substrate;

combined clip/cam means attachable to the end of said housing opposite said first end portion at least for retaining said writing means therein;

means for positioning said writing means in one of a first position whereby said writing means extends through said tip means and is capable of contacting a substrate for writing thereupon, or a second position whereby said writing means is maintained with said tip means and housing;

said tip means and clip/cam means each including an extension member dimensioned and configured for insertion into said central opening of said housing in interference relation therewith for retention of said tip means and clip/cam means in engagement therewith; and means for extending and retracting said cartridge including a plunger terminating in a set of teeth; a ratchet member dimensioned for positioning within said clip/cam means and having a set of teeth on its outer surface; and a plurality of slots on the inner surface of said clip/cam means, said slots being dimensioned and configured to cause alternative engagement and turning of said plunger teeth to permit entry of the ratchet teeth into the slots, and to retain the ratchet in a retract position, said ratchet further being provided with an inwardly positioned set of auxiliary teeth for contact with said plunger teeth when said plunger engages said ratchet, said ratchet being further provided with an elongated extension which is received within said plunger to thereby facilitate high speed assembly of said plunger and ratchet.

17. The writing instrument of claim 16 wherein said writing medium is ink and said plunger includes means for indicating the color of said ink.

18. The writing instrument of claim 17 wherein said ink color indicating means comprises an end portion of said plunger and a sleeve member positioned therearound.

19. The writing instrument of claim 16 which further comprises a spring operatively associated with said cartridge and said extending and retracting means to facilitate the extension and retraction of said cartridge.

20. The writing instrument of claim 19 wherein said cartridge includes a pair of outwardly extending members for retaining one end of said spring in position relative to said cartridge, and wherein said tip means includes a shoulder therein dimensioned and configured for retaining the opposite end of said spring.

21. The writing instrument of claim 16 wherein said clip/cam means and said opposite end of said housing tube each include threads for locking engagement therebetween and further wherein said cartridge is replaceable.

22. A writing instrument comprising:

an elongated housing having a generally uniform cross section and defining a central opening along its length;

a tip member attachable to said housing at a first end and defining an opening communicable with said central opening of said housing;

writing means positionable within at least a portion of said central opening of said housing and extending through said tip member for writing on a substrate, said writing means including a cartridge having a writing tip and supply of ink therein;

a combined clip/cam member attachable to the end of said housing opposite said first end for retaining said writing means therein; and means for extending and retracting said cartridge including a plunger terminating in a set of teeth; a ratchet member dimensioned for positioning within said clip/cam member and having a set of teeth on its outer surface; and a plurality of slots on the inner surface of said clip/cam member, said slots being dimensioned and configured to cause alternative engagement and turning of said plunger teeth to permit entry of the ratchet teeth into the slots, and to retain the ratchet in a retract position, said ratchet further being provided with an inwardly positioned set of auxiliary teeth for contact with said plunger teeth when said plunger engages said ratchet, said ratchet being further provided with an elongated extension which is received within said plunger to facilitate high speed assembly of said plunger and ratchet;

said tip and clip/cam members each including an extension dimensioned and configured for insertion into said central opening of said housing in interference relation therewith and means for retention of said tip and clip/cam members in locking engagement therewith;

wherein said cartridge is movable to one of a first extended position wherein said cartridge tip extends beyond the forward end of said tip member for writing upon the substrate, or a second position wherein said cartridge tip is retracted within said tip member for storage during periods of non-use.

23. The writing instrument of claim 22 wherein each means for locking engagement of the tip and clip/cam members includes a circumferential rib on an outer surface thereof.

24. The writing instrument of claim 22 wherein said plunger includes means for indicating the color of said ink; and which further comprises a spring operatively associated with said cartridge to facilitate the extending and retracting of said cartridge.

25. The writing instrument of claim 24 wherein said ink color indicating means comprises an end portion of said plunger and a sleeve member positioned therearound; and wherein said cartridge includes a pair of outwardly extending members for retaining one end of said spring in position relative to said cartridge, and wherein said tip member includes a shoulder therein dimensioned and configured for retaining the opposite end of said spring.

26. The writing instrument of claim 22 wherein said clip/cam member further comprises a clip member to facilitate selective attachment to clothing or the like.

27. The writing instrument of claim 22 wherein said clip/cam member and said opposite end of said housing tube each include threads for locking engagement therebetween and further wherein said cartridge is replaceable.

28. The writing instrument of claim 22 wherein the outer surface of said housing is sandblasted to provide a soft finish thereon.

29. A writing instrument comprising:

an elongated housing having a generally uniform cross section, defining a central opening along its length, and including an outer covering of a soft feel material;

a tip member attachable to said housing at a first end and defining an opening communicable with said central opening of said housing;

writing means positionable within at least a portion of said central opening of said housing and extending through said tip member for writing on a substrate, said writing means including a cartridge having a writing tip and supply of ink therein;

a clip/cam member attachable to the end of said housing opposite said first end for retaining said writing means therein; and means for extending and retracting said cartridge including a plunger terminating in a set of teeth; a ratchet member dimensioned for positioning within said clip/cam member and having a set of teeth on its outer surface; and a plurality of slots on the inner surface of said clip/cam member, said slots being dimensioned and configured to cause alternative engagement and turning of said plunger teeth to permit entry of the ratchet teeth into the slots, and to retain the ratchet in a retract position, said ratchet further being provided with an inwardly positioned set of auxiliary teeth for contact with said plunger teeth when said plunger engages said ratchet, said ratchet being further provided with an elongated extension which is received within said plunger to facilitate high speed assembly of said plunger and ratchet;

said tip and clip/cam members each including an extension dimensioned and configured for insertion into said central opening of said housing in interference relation therewith and means for retention of said tip and clip/cam members in locking engagement therewith;

wherein said cartridge is movable to one of a first extended position wherein said cartridge tip extends beyond the forward end of said tip member for writing upon the substrate, or a second position wherein said cartridge tip is retracted within said tip member for storage during periods of non-use.

30. The writing instrument of claim 29 wherein said outer covering is made of a plastic or elastomeric material having a durometer which provides cushioned comfort to the user and further provides non-slip contact with the user's hand.

31. The writing instrument of claim 30 wherein said outer covering includes at least one decorative score line therein.

32. The writing instrument of claim 31 wherein said score line extends through said outer covering to reveal a color different from that of said outer covering.

33. The writing instrument of claim 32 wherein a plurality of said score lines are provided in a predetermined pattern.

34. The writing instrument of claim 29 wherein said clip/cam member and said opposite end of said housing tube each include threads for locking engagement therebetween and further wherein said cartridge is replaceable.

* * * * *